US005560694A

United States Patent [19]

Banicevic et al.

[11] Patent Number: 5,560,694

[45] Date of Patent: Oct. 1, 1996

[54] LABYRINTH DOOR SEAL FOR A REFRIGERATOR

[76] Inventors: Nedo Banicevic, 1968 Main St. W., #608, Hamilton, Ontario, Canada, L85 1J5; Doug J. Pettit, 1 Ninth St., Grimsby, Ontario, Canada, L3M 3T7

[21] Appl. No.: 353,971

[22] Filed: Dec. 6, 1994

[30] Foreign Application Priority Data

Dec. 9, 1993 [CA] Canada ..... 2111066

[51] Int. Cl.[6] ..... A47B 96/00; E06B 7/16

[52] U.S. Cl. ..... 312/405; 49/478.1; 49/475.1

[58] Field of Search ..... 312/405, 116, 312/236, 138.1; 49/472–474, 475.1, 478.1

[56] References Cited

U.S. PATENT DOCUMENTS

| | | | |
|---|---|---|---|
| 3,157,306 | 11/1964 | Courson | 312/405 |
| 3,294,462 | 12/1966 | Kesling | 312/405 |
| 3,359,053 | 12/1967 | Hagendoorn | 312/405 X |
| 4,134,626 | 1/1979 | Kordes | 312/405 |
| 4,469,383 | 9/1984 | Losert | 312/405 X |
| 4,644,698 | 2/1987 | Gerdes et al. | 49/478.1 |
| 4,653,819 | 3/1987 | Swerbinsky | 312/405 X |
| 4,916,864 | 4/1990 | Thompson | 49/478.1 |
| 5,193,310 | 3/1993 | Kiel | 49/478.1 X |
| 5,297,360 | 3/1994 | Besore et al. | 49/478.1 X |

*Primary Examiner*—Peter M. Cuomo
*Assistant Examiner*—Robert J. Sandy

[57] ABSTRACT

A novel refrigerator door liner construction and sealing gasket provides an improvement in the insulating value of a refrigerator door in the area immediately adjacent the gasket. The door liner is arranged to have a raised abutment adjacent a flat sealing portion of the gasket. The door liner almost abuts an adjacent surface of a refrigerator cabinet liner when the door is closed so as to effectively form a labyrinth seal with the gasket sealing portion between the door liner and the cabinet liner. The labyrinth seal provided between the door liner and refrigerator cabinet liner reduces the heat stress on the gasket and improves the overall efficiency of the refrigerator.

9 Claims, 2 Drawing Sheets

LABYRINTH DOOR SEAL FOR A REFRIGERATOR

Manufacturers of refrigerators at the present are being challenged to produce a refrigerator which consumes less energy for a given capacity than heretofore been possible. As a result the manufacturers have taken steps to increase the insulation capability of the walls and doors of the refrigerator. The gaskets have been improved so that the escape of heat into the refrigerator is impeded and the use of electric heating elements to prevent the build up of frost or moisture on parts of the refrigerator that have been subject to this build up has been discouraged.

This invention seeks to improve the operating efficiency of the refrigerator by improving the construction of the door so as to reduce the clearance between the door and the abutting wall so reduce the chance for heat flow into the refrigerator.

BACKGROUND OF THE INVENTION

Prior art refrigerators which have been provided with refrigeration compartments and in some instances refrigeration and freezing compartments in the same general shell have been constructed by the manufacturers to provide excellent resistance to heat flow through the walls and doors of the refrigerators. As the environmental movement has demanded a more effective heat barrier, the manufacturers have increased the insulating capability of the insulation contained therein so that the greatest chance for the admission of heat into the, interior of the refrigerator is through the door gasket seal interface. Efforts have, been made to decrease the clearance between the door liner and the refrigerator wall to reduce the opportunity for heat flow between the door liner and the abutting wall however, the distance which must be maintained between the wall and the door liner is dictated by providing suitable clearance for the liner to swing when the door is opened. Manufacturing tolerances dictate the minimum gap which is allowable; between the door liner and the adjacent refrigerator wall. Because the door must swing in an arc, the part of the door liner which protrudes the furthest into the refrigerator opening tends to brush the refrigerator wall when the door is opened or closed.

In the past, the refrigerator wall and the door liner were arranged to meet at an angle so that the arc traced by the door liner poses the least interference possible with the refrigerator wall. Although this left a fairly large gap between the liner and the door wall when the refrigerator door is closed it was felt that the gasket between the door and the frame of the refrigerator could present sufficient thermal resistance to allow an acceptable amount of heat into the refrigerator.

SUMMARY OF THE INVENTION

This invention seeks to overcome the deficiencies of prior refrigerator construction design by the provision of a labyrinth seal between the door and the cabinet of the refrigerator. The labyrinth is formed by changing the shape of the liner cabinet interface adjacent the gasket assembly. It is in this region that it is possible to close the gap between the door and the cabinet so that it is difficult for heat to penetrate the very narrow gap left between the door and the cabinet. This also reduces the heat stress on the gasket assembly provided between the door and the cabinet as well.

A BRIEF DESCRIPTION OF THE DRAWINGS

A better understanding of the invention will be found when taken with the accompanying drawings in which.

DESCRIPTION OF THE PREFERRED EMBODIMENT

Figure 1:
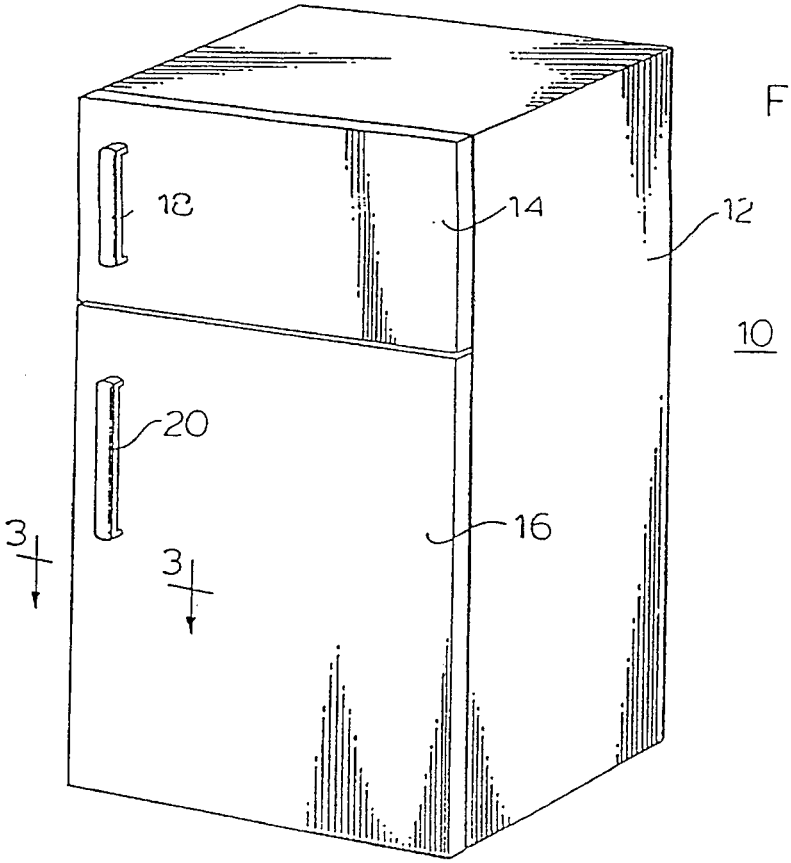
FIG. 1 is a perspective view of a refrigerator.

Referring now to FIG. 1 which shows a refrigerator of the type having a freezer and fresh food compartment combined in the same cabinet. (It is understood that this invention applies equally well to refrigerators having only a fresh food compartment). Refrigerator 10 is shown having a divided cabinet 12 which is closed by a freezer door 14 and fresh food compartment door 16. The freezer door has a handle 18, the fresh food compartment door has a handle 20.

Figure 2:
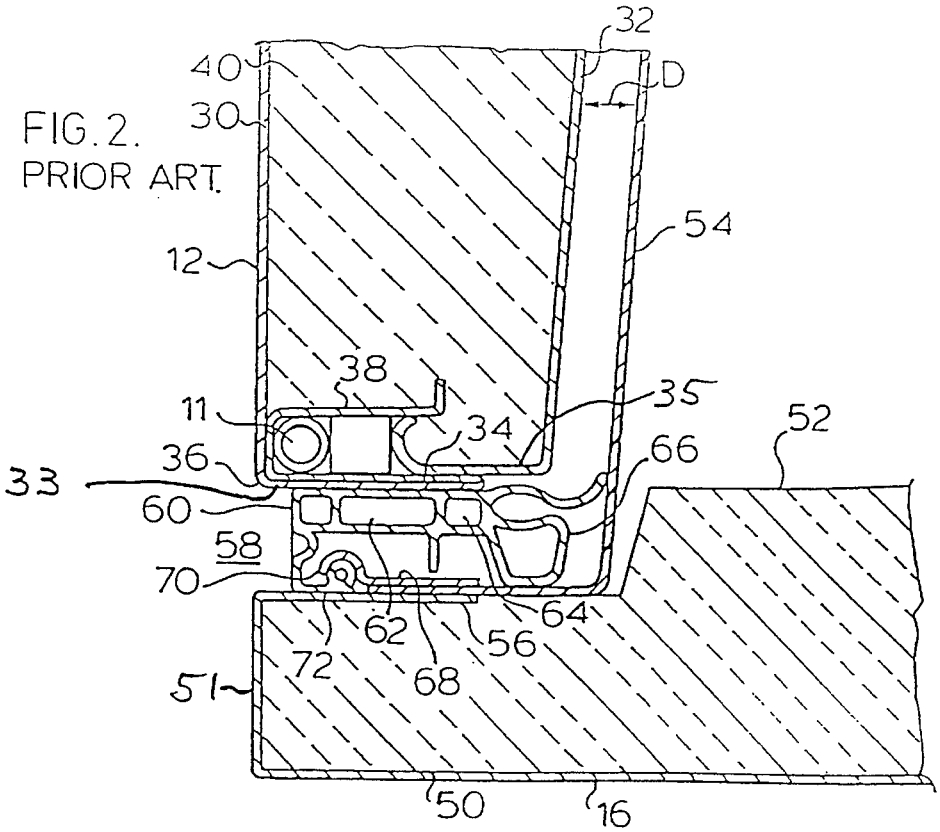
FIG. 2. PRIOR ART.
FIG. 2 is a cross section of the door cabinet interface of a refrigerator with the prior art construction.

Referring now to FIG. 2 in which door 16 is shown in a cross-section closed position with respect to cabinet 12. Cabinet 12 is shown comprising an outer cabinet steel shell 30 in which a non-metallic cabinet liner 32 is mated at the cabinet liner interface 34. It will be seen that the shell 30 is bent at corner 36 to form a right angle to give the cabinet the required strength and provide a magnetic leading cabinet surface 33 for the gasket to meet. The cabinet liner 32 is arranged with an out-turned cabinet liner 35 to fit into device 38 which is provided to increase cabinet strength and to accept any condensation formed in this area and lead it to an area of evaporation. Device 11, which in this instance is a tube carrying warm refrigerant which slightly warms the liner interface area 34. Those skilled in the art will realize that this area is subject to moisture collection if the temperature of the area of the cabinet liner interface becomes less than the dewpoint of the surrounding air.

Lastly, the area between the cabinet 30 and the liner 32 is filled with a suitable insulation 40.

Door 16 is swung from a hinge at the far right of the page. The door is constructed of a metallic steel outer shell 50 which is folded at 51 to form a sturdy enclosure for insulation 52. The insulation for the door and the cabinet will be of a insulation suitable for refrigerators of present day construction which is generally formed from a foamed polyurethane or some other suitable substance. The insulation forms no part of this invention. A non-metallic liner 54 is molded to fit into the door at 56. A gasket 58 is provided at the door cabinet interface to seal the inner compartment from the atmosphere. Gasket 58 may be a complex structure having a tubular portion 60 and a magnet portion 62 and an inner hollow section 64 to present a high resistance heat flow path. The inside wall of gasket 58, 66 closes the entire gasket assembly. A keeper 68 engages bead 72 at the, extremity of the gasket 58. Gasket 58 may have several internal members extending between the cabinet wall engaging portion and the door portion of the, gasket to increase the rigidity or to decrease resilience of the gasket assembly 58. It will be seen that it is impossible to decrease the distance D between the cabinet liner 32 and the door liner 54 beyond a certain minimum distance. It will be noted that prior art designs maintain this distance even in the vicinity of the gasket 58.

Figure 3:
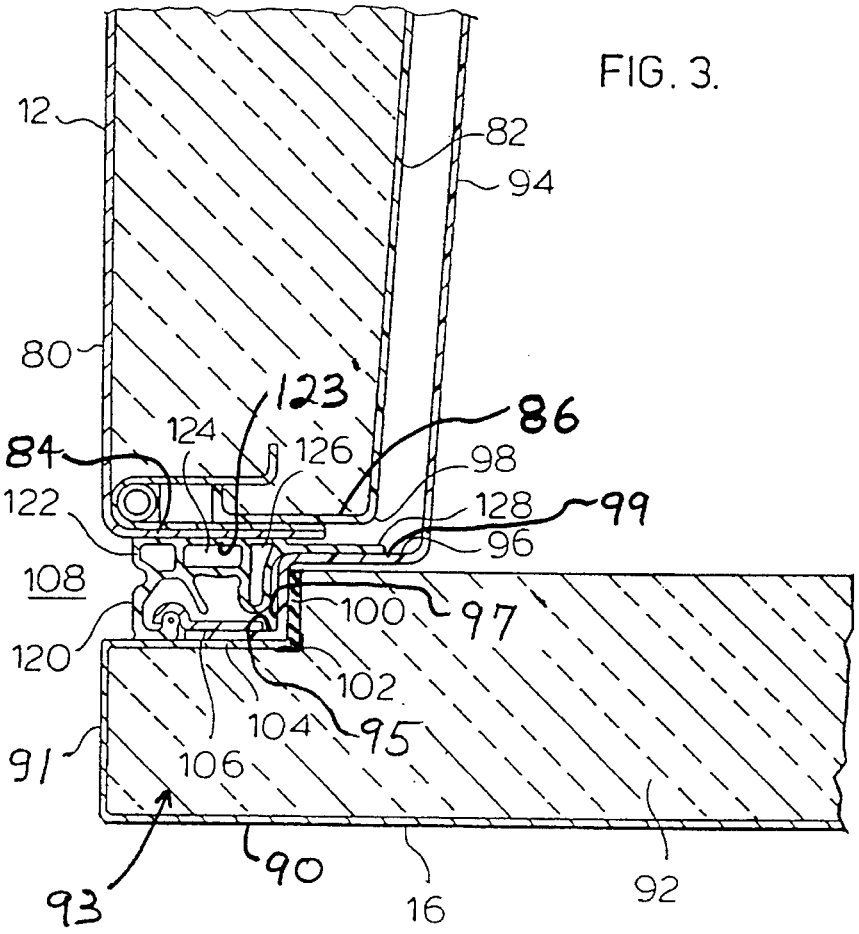
FIG. 3 is a sectional view of the door and cabinet construction of the invention of this application.

Referring now to FIG. 3, wherein the invention of this application is disclosed, it will be seen that the refrigerator 10 is provided again with a cabinet 12 and a door 16 in a closed relationship. Cabinet 12 is provided again with an outer cabinet steel shell 80 (which is formed similar manner to the shell of FIG. 2) which is folded to provide a leading cabinet surface 84 which is in front of and engages an out-turned cabinet liner portion 86 of a cabinet liner 82. Cabinet liner 82 mates with shell 80 in a similar manner to the cabinet liner 32 and shell 30 of FIG. 2. The door 16 in FIG. 3 however, is constructed to have an entirely different contour in the area of the cabinet door interface than the prior art door shown in FIG. 2. Refrigerator door 16 thus composes an outer metallic shell 90 which is constructed in a manner similar to the door of FIG. 2 in that the steel is folded at 91 to provide an outside periphery edge and a flat mounting door surface 104 spaced parallel in such a matter from the outer shell 90 to provide a hollow area 93 for insulation 92. Door 16 is provided with a liner 94 which is mounted on the door in a similar manner to the liner 54 of the prior art. It will be seen that liner 94 is provided with a step 96 directly opposite the corner 98 of the cabinet liner. The door liner continues to follow the contours of the steel shell 90 of the door 16 at interface 100 and the liner is formed into a bend at 102 and is mounted on the flat mounting surface 104 of door 16. The non-metallic door liner 94 has a first door liner surface 95 extending parallel to and in mating relation to the flat mounting door surface 104. The liner 94 includes a second door liner surface 97 extending substantially orthogonally from the first door liner surface 95 and a third door liner surface 99 extending parallel to the first door liner surface 95 where the second door liner surface 97 provides a step riser for the third door liner surface. The third door liner surface 97 is illustrated to be a further distance from the outer shell 90 than the first door liner surface 95. Keeper 106 is provided to hold the gasket and liner 94 against the door 16 in the area of mounting door surface 104. Gasket 108 is essentially similar to gasket 58 in FIG. 2 however, the shape of the gasket must be altered to accommodate the change of shape of the door liner in the areas of 106. Gasket 108 is therefore provided with wall 120 which is exposed to atmosphere and the gasket has a bead 122 formed integrally therein as well as the magnetic portion 124. A rectangular bead 126 is formed adjacent the magnet chamber 124. Gasket 108 has an upper wall or cabinet sealing portion 123 which extends above the third door liner surface 99. Gasket 108 includes an inner flat labyrinth door liner seal portion 128 arranged to lie on the third door liner surface 99 of door liner 94. Liner 94 is formed such that seal portion 128 of the door gasket 108 forms a labyrinth type seal with the adjacent cabinet liner 82 at 98. It will be seen that when the door is closed, that the surface 128 is made to almost touch the inner liner 82 at 98 and thus provide a very narrow passageway for the penetration of heat into the refrigerator chamber. The gap left between seal portion 128 and cabinet liner corner 98 is a controlled gap and maybe made to approach zero because there is no problem with maintaining clearance with the liner wall during the opening of the door. By narrowing the gap between third door line surface 99 and the out-turned cabinet liner portion 86 causes the gap between these surfaces to be substantially the thickness of the seal portion 98. It is possible to provide a refrigerator door which seals in a more efficient manner than the prior art designs. The presence of the labyrinth seal in the door cabinet interface tends to relieve the gasket 108 of some of the heat stress previously applied to the gasket in prior art designs. It will be seen that with the seal of the present invention tends to ameliorate the problems of moisture buildup on the door cabinet interface and the operating efficiency of the refrigerator will be substantially increased.

Figure 4:
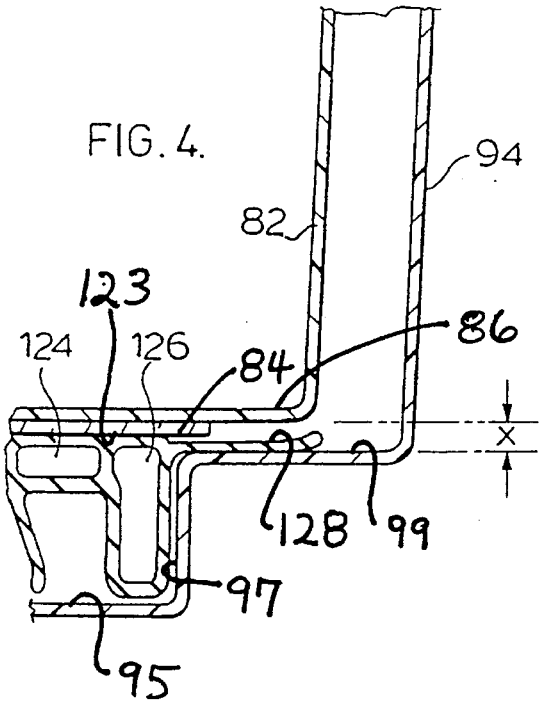
FIG. 4 is an enlarged view of the area of the labyrinth seal.

FIG. 4 shows an enlarged view of the labyrinth area of the door cabinet interface showing the distance X which may be made much smaller than distance D because of its location. The minimum value of the distance X is only limited by the tolerances required in the manufacturing assembly of the door and cabinet. Thus in reality X maybe a very small number.

The embodiments of the invention in which an exclusive property or privilege is claimed are defined as follows:

1. A door for use in association with a domestic refrigerator comprising:

a metallic outer shell having a fold forming an outside periphery edge and a flat mounting surface parallel to and spaced from the outer shell to provide a hollow area therebetween;

a non-metallic liner having a first liner surface extending parallel to and in mating relation to the flat mounting surface of the outer shell to form a hollow structure within the door, the non-metallic liner having a second liner surface extending substantially orthogonally from the first liner surface and a third liner surface extending substantially parallel to the first liner surface where the second liner surface provides a step riser for the third liner surface spacing the third liner surface further from the outer shell than the first liner surface;

an insulating medium contained within the hollow structure for preventing ready ingress of heat through the door; and, gasket means secured to said door adjacent the first liner surface and the flat mounting surface, said gasket means extending past the third liner surface, and said gasket means including a flat labyrinth sealing surface portion extending laterally therefrom to lie over and sealingly engage the third liner surface.

2. The door of claim 1 wherein the second liner surface rises inwardly to a distance slightly below a sealing surface of said gasket means.

3. The door of claim 1 wherein the outer metallic shell is folded at the flat mounting surface to form an interface surface extending generally orthogonal to the flat mounting surface.

4. The door of claim 3 wherein the first and second liner surfaces respectively follow the contour of the flat mounting surface and interface surface of the outer metallic shell.

5. A domestic refrigerator comprising:

a cabinet including an outer cabinet steel shell folded at a right angle to provide a leading cabinet surface, a non-metallic cabinet liner having an out-turned cabinet liner portion adapted to mate with the outer cabinet steel shell behind the leading cabinet portion;

a door comprising: a metallic outer door shell having a fold forming an outside periphery edge and a flat mounting door surface parallel to and spaced from the outer door shell to provide a hollow area therebetween; and a non-metallic door liner having a first door liner surface extending parallel to and in mating relation to the flat mounting door surface of the outer door shell, the non-metallic door liner having a second door liner surface extending substantially orthogonally from the first door liner surface and a third door liner surface extending substantially parallel to the first door liner surface where the second door liner surface provides a step riser for the third door liner surface spacing the third door liner surface further from the outer door shell than the first door liner surface; and, gasket means secured to said door adjacent the first door liner surface and the flat mounting surface, said gasket means having a cabinet sealing portion extending past the third liner surface for engaging the leading cabinet surface, and said gasket means including a flat labyrinth door liner sealing portion having extending laterally from the cabinet door sealing portion to lie over and sealingly engage the third door liner surface and to space the third door liner surface from the out-turned cabinet liner portion by the thickness of the door liner seal portion.

6. The domestic refrigerator of claim 5 wherein the third door liner surface extends parallel to the out-turned cabinet liner.

7. The domestic refrigerator of claim 6 wherein the second door liner surface rises inwardly to a distance slightly below the cabinet sealing surface of said gasket means.

8. The domestic refrigerator of claim 6 wherein the outer metallic door shell is folded at the flat mounting door surface to form an interface door surface extending generally orthogonal to the flat mounting door surface.

9. The domestic refrigerator of claim 8 wherein the first and second door liner surfaces respectively follow the contour of the flat mounting door surface and interface door surface of the outer metallic shell.

* * * * *